US011731306B1

(12) United States Patent
Wang

(10) Patent No.: US 11,731,306 B1
(45) Date of Patent: Aug. 22, 2023

(54) PUSH BLOCK SAFE INDEX SCALE

(71) Applicant: Henry Wang, Winter Springs, FL (US)

(72) Inventor: Henry Wang, Winter Springs, FL (US)

( * ) Notice: Subject to any disclaimer, the term of this patent is extended or adjusted under 35 U.S.C. 154(b) by 0 days.

(21) Appl. No.: 17/982,613

(22) Filed: Nov. 8, 2022

(51) Int. Cl.
*B27B 25/10* (2006.01)
*B27B 27/10* (2006.01)

(52) U.S. Cl.
CPC ..... *B27B 25/10* (2013.01); *B27B 27/10* (2013.01)

(58) Field of Classification Search
CPC ..... B27C 5/06; B27B 25/10; B27B 27/02; Y10T 83/727; Y10T 83/773
See application file for complete search history.

(56) References Cited

U.S. PATENT DOCUMENTS 751,121 A 2/1904 Tidey
1,032,278 A 7/1912 England
1,710,718 A 4/1929 Stotz
2,134,606 A 10/1938 Hackworth et al.
2,410,467 A 11/1946 Valentine
2,522,965 A 9/1950 Schaufelberger
2,620,929 A 12/1952 Sportsman
2,754,857 A 7/1956 Joslin
2,839,100 A 6/1958 Valicenti
2,895,513 A 7/1959 Cowley
2,929,419 A 3/1960 Johnson
3,934,341 A 1/1976 Carlson
4,001,903 A 1/1977 Hay
4,066,250 A 1/1978 Campbell
D248,144 S 6/1978 Kreitz
4,348,925 A 9/1982 Manweiler
4,370,909 A 2/1983 Jennings
4,432,263 A 2/1984 Kowalchuk
4,476,757 A 10/1984 Morris
4,485,711 A 12/1984 Schnell
D278,022 S 3/1985 Ash
D278,790 S 5/1985 Chaney et al.
4,603,612 A 8/1986 Atkins
5,016,509 A * 5/1991 Stottman ..... G01B 3/30 83/477.2
5,140,778 A 8/1992 Carruth
D342,658 S 12/1993 Gakhar et al.
5,330,167 A 7/1994 Plumb
5,341,711 A 8/1994 Stay, Jr. et al.
5,662,019 A 9/1997 Denman
5,678,467 A 10/1997 Aigner
5,875,827 A 3/1999 Brutscher et al.
(Continued)

*Primary Examiner* — Jennifer S Matthews
(74) *Attorney, Agent, or Firm* — Wolter Van Dyke Davis, PLLC; Robert L. Wolter

(57) ABSTRACT

An apparatus (100), including: a push block (102) configured to push a workpiece across a table saw, the push block including: a first leg (120), a second leg (130) having a fence side (132) configured to abut a fence of the table saw, and a center leg (140) disposed between the first leg and the second leg. The first leg and the center leg define a first tunnel (152) therebetween, and the center leg and the second leg define a second tunnel (154) therebetween; a scale (160) configured to indicate a distance along the push block from the fence when the fence side of the second leg abuts the fence; and a cursor (162) configured to indicate on the scale safe cut-width settings for the table saw in which a saw blade will not contact the center leg when the fence side of the second leg abuts the fence.

18 Claims, 6 Drawing Sheets

(56) References Cited

U.S. PATENT DOCUMENTS

| | | | | |
|---|---|---|---|---|
| 5,894,777 | A | 4/1999 | Sterling | |
| 6,044,740 | A | 4/2000 | Werkheiser | |
| 6,098,972 | A | 8/2000 | Klimach et al. | |
| 6,135,521 | A | 10/2000 | Wirth, Jr. et al. | |
| 6,164,176 | A | 12/2000 | Larsson | |
| 6,196,283 | B1 | 3/2001 | Hundegger | |
| 6,382,608 | B1 | 5/2002 | Michell | |
| 6,491,073 | B1 | 12/2002 | Essick | |
| 6,732,623 | B1 | 5/2004 | Jennings | |
| 7,040,206 | B2 * | 5/2006 | Wang | B27C 5/06 83/438 |
| 7,540,224 | B2 * | 6/2009 | Wang | B27C 5/06 83/438 |
| 8,402,869 | B2 * | 3/2013 | Gass | B27B 13/14 83/DIG. 1 |
| 9,199,390 | B2 | 12/2015 | Wang | |
| 2004/0060411 | A1 * | 4/2004 | Svetlik | B23D 59/001 83/477.2 |
| 2007/0006703 | A1 * | 1/2007 | Lin | B27B 27/02 83/522.11 |
| 2014/0260864 | A1 * | 9/2014 | Wang | B27B 25/10 83/436.2 |
| 2015/0290832 | A1 * | 10/2015 | Wang | B27B 25/10 83/436.2 |
| 2021/0138682 | A1 * | 5/2021 | Fife | B27B 25/10 |

* cited by examiner

PUSH BLOCK SAFE INDEX SCALE

FIELD OF THE INVENTION

This invention relates generally to the field of woodworking tools, and more particularly to the field of accessories for feeding stock safely across a saw table.

BACKGROUND OF THE INVENTION

A table saw typically includes a flat, horizontally oriented table having an opening formed therein through which a top portion of a circular saw blade protrudes. The saw blade may be 10-12 inches in diameter, for example, and is motor driven to rotate at a speed of 3,000 revolutions per minute or more. A piece of stock material, typically wood, may be cut by moving it across the table to intersect the spinning saw blade. The height of the top of the saw blade above the table may be adjustable within predetermined limits in order to accommodate stock material of various thicknesses. A fence is provided with a table saw to guide the movement of the stock in a direction parallel to the plane of the saw blade in order to ensure a straight cut and to avoid binding of the non-cutting portions of the saw blade within the stock material. A fence typically includes an elongated metal bar having a flat guide face oriented at a right angle with respect to the table and parallel to the plane of the saw blade. The distance between the fence guide face and the saw blade may be adjustable within predetermined limits in order to accommodate stock material and cut locations having various widths.

U.S. Pat. No. 7,540,224, incorporated by reference herein in its entirety, describes a sophisticated prior art adjustable pushing apparatus for safely moving a work piece past a saw blade. As can be seen in FIG. 1, the prior art adjustable pushing apparatus 50 includes a main body 52 to which other portions of the apparatus 50 are attached, either directly or indirectly. Other portions of the apparatus 50 include a handle 54, a first leg 56, a second leg 58 and a center leg 60. The apparatus 50 defines two tunnels 62, 64 through which a cutting device may pass when the apparatus 50 is used to push a piece of stock material. The apparatus 50 may be assembled in several different configurations and may be used in several different manners to safely accomplish a variety of material-removal operations on a variety of sizes of material.

The apparatus 50 may be formed of component parts that can be attached or removed as desired. Body 52 is the structural base to which other components are attached, either directly or indirectly. Body 52 may be formed to include a slot or keyway 66 on opposed leading and trailing edges for receiving mating tongues or keys 68 formed on respective leading and trailing portions of center leg 60. Center leg 60 is assembled onto body 52 by sliding keys 68 into the opening slot of keyways 66 to position center leg 60 at a selected location along the underside 70 of body 52. The center leg 60 may be affixed at any selected location by tightening thumb screws 72 into mating nuts (not shown) located within the keyway 66, thereby drawing the keys 68 tight against the body 52. The location of center leg 60 defines the respective widths of tunnels 62,64.

First leg 56 and second leg 58 may be assembled onto the sides of body 52 by threading bolts through counter-bored holes in the respective leg into nuts embedded or otherwise retained in body 52. (The hardware is not shown in the FIGURES.) Each of the legs 56, 58 includes a flat side surface 74 adapted for abutting a flat guide surface of a saw table fence. Any mounting hardware exposed along the side surface 74 should be mounted flush or counter-bored below surface 74 so as not to interfere with the smooth movement of side surface 74 across a guide surface. Apparatus 50 may be assembled to include one or both of first leg 56 and second leg 58, depending upon the requirements of a particular operation. The legs 56, 58, 60 each extend away from the underside 70 of body 52 to form respective work piece-contacting surfaces 76. These work piece-contacting surfaces 76 are preferably non-slip surfaces, being formed from a material that does not easily slide over a work piece surface, for example rubber or a thermoplastic elastomer. A non-slip material may be molded into or may be attached to the bottom of the respective leg 56, 58 with an adhesive, or a non-slip material may be partially embedded into the bottom surface of the legs, or the material of the legs may be sufficiently roughened to be non-slip. It is preferred that the non-slip material used to form work piece-contacting surface 76 be slightly recessed from the first and second leg side surfaces 74 so as not to interfere with the smooth movement of side surface 74 across a fence guide surface. The elastomer is sufficiently soft that it will deform to accommodate the inherent unevenness of a molded plastic surface, thereby further increasing its non-slip property. Grooves 77 may be formed in the surface 76 to accommodate a degree of unevenness of the leg and work piece surfaces and also to accommodate sawdust or other debris deposited on the work piece surface.

Body 52 and legs 56, 58 may include keyways 78 for capturing hardware used to attach handle 54 and/or other accessories. Handle 54 may be moved to any selected position between first leg 56 and second leg 58, then locked into place by tightening bolts 80. Bolt 80 passed through a hole formed in handle 54 and is threaded into a nut disposed within the keyway 78. The location of handle 54 with respect to body 52 may be selected to most advantageously locate the point of application of forces to be applied by an operators hand on the handle 54. Handle 54 may be aligned to be parallel to leg side surface 74 or it may be fixed at an askew position so that the longitudinal axis of the handle 54 is disposed at an angle to the cut line of the saw blade 16 and to a longitudinal axis of the apparatus 50.

BRIEF DESCRIPTION OF THE DRAWINGS

The invention is explained in the following description in view of the drawings that show.

DETAILED DESCRIPTION OF THE INVENTION

The present inventor has devised a unique and innovative push block that incorporates visual indication of safe cut-width settings for a table saw used therewith. When the table saw cut-width is set within the safe cut-width settings indicated on the push block, and when the push block is used against a fence of the table saw, the saw blade will not contact one or more features of the push block. In an example embodiment, the push block includes a center leg and the safe cut-width settings indicated ensure the saw blade does not contact the center leg. In an example embodiment, a distance of the center leg from the fence is adjustable and the visual indication changes as the center leg is moved to reflect changes in the distance of the center leg from the fence. In other example embodiments, the safe cut-width settings indicated ensure the saw blade does not contact a first (outer) leg or a second (fence side) leg of the push block.

Figure 1:
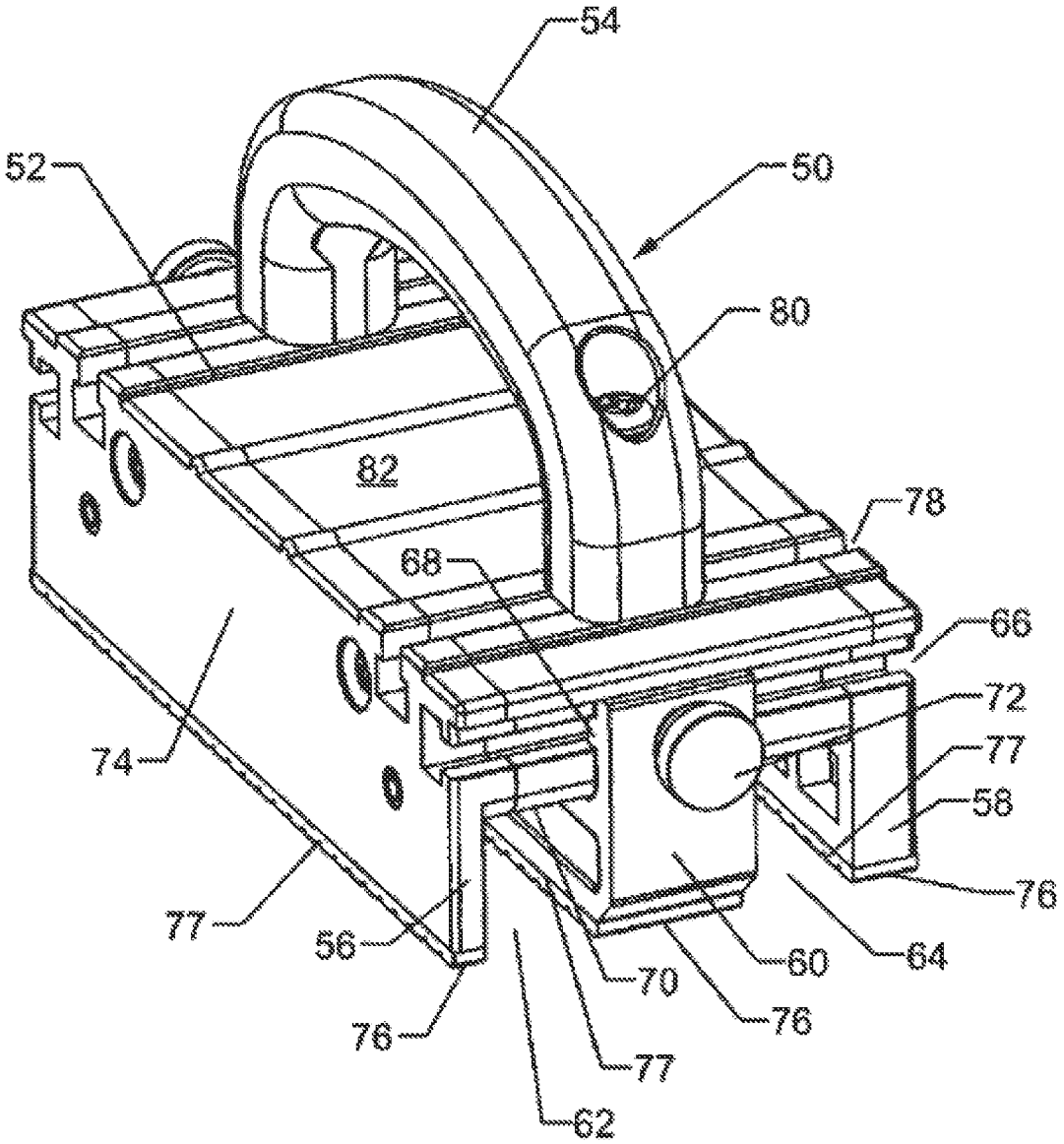
FIG. 1 Prior Art
FIG. 1 is a perspective view of a prior art pusher apparatus.
Figure 2:
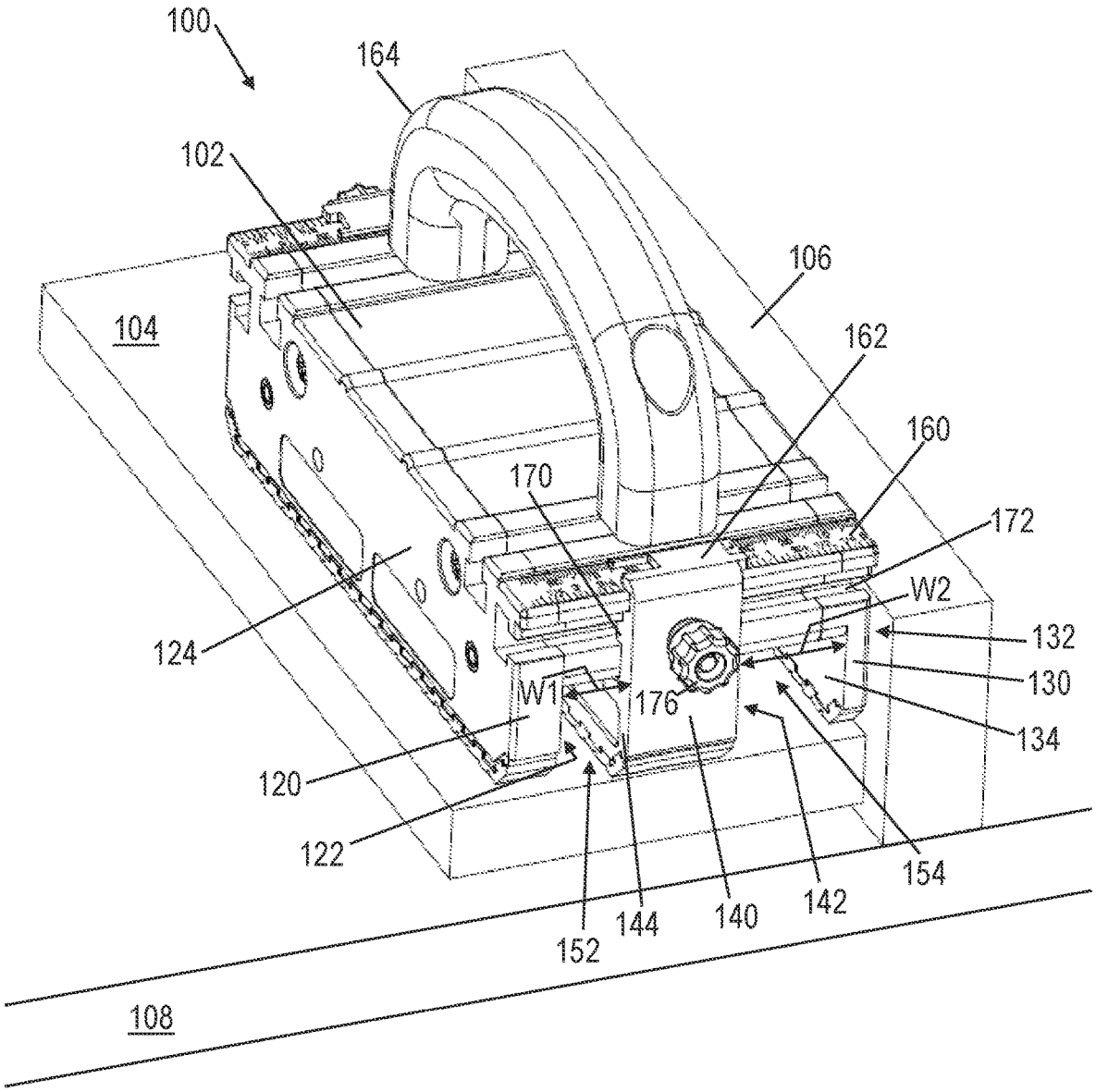
FIG. 2 is a perspective view of an example embodiment of a push block disclosed herein.

FIG. 2 shows an apparatus 100, that includes a push block 102 configured to push a workpiece 104 along a fence 106 of a table saw 108 having a saw blade 110. The push block 102 includes: a first leg 120 having a fence side 122 and an outside side 124; a second leg 130 having a fence side 132 and an outside side 134; and a center leg 140 disposed between the first leg 120 and the second leg 130 and having a fence side 142 and an outside side 144. The first leg 120 and the center leg 140 define a first tunnel 152 therebetween. The center leg 140 and the second leg 130 define a second tunnel 154 therebetween. The push block 102 further includes a scale 160 (e.g., a ruler that is disposed on the push block) having a plurality of distance indicators 160E, 160M that are configured to indicate a distance along the push block 102 measured from the fence side 132 of the second leg 130 (e.g., a distance from the fence along a line that is perpendicular to the fence). When the fence side 132 of the second leg 130 abuts the fence 106, the scale 160 also indicates a distance measured along the push block 102 from the fence 106. The push block 102 further includes a cursor 162 configured to indicate on the scale 160 safe cut-width settings for the table saw 108 in which a saw blade 110 will not contact the center leg 140 when the fence side 132 of the second leg 130 abuts the fence 106. The apparatus may further include a handle 164 and various other accessories (not shown).

In an example embodiment, a position and associated distance of the center leg 140 relative to the fence side 132 of the second leg 130 (and thereby relative to the fence 106 when the fence side 132 of the second leg 130 abuts the fence 106) is laterally adjustable via a key 170 and slot 172 arrangement. However, any arrangement that permits this lateral adjustment is suitable. The center leg 140 may be selectively secured in any lateral position via a thumb screw 176 or the like. Adjustment of the position of the center leg 140 adjusts a first tunnel width W1 and a second tunnel width W2. In this example embodiment, the cursor 162 is operatively connected to the center leg and thereby configured to move along the scale 160 with the center leg 140.

Figure 3:
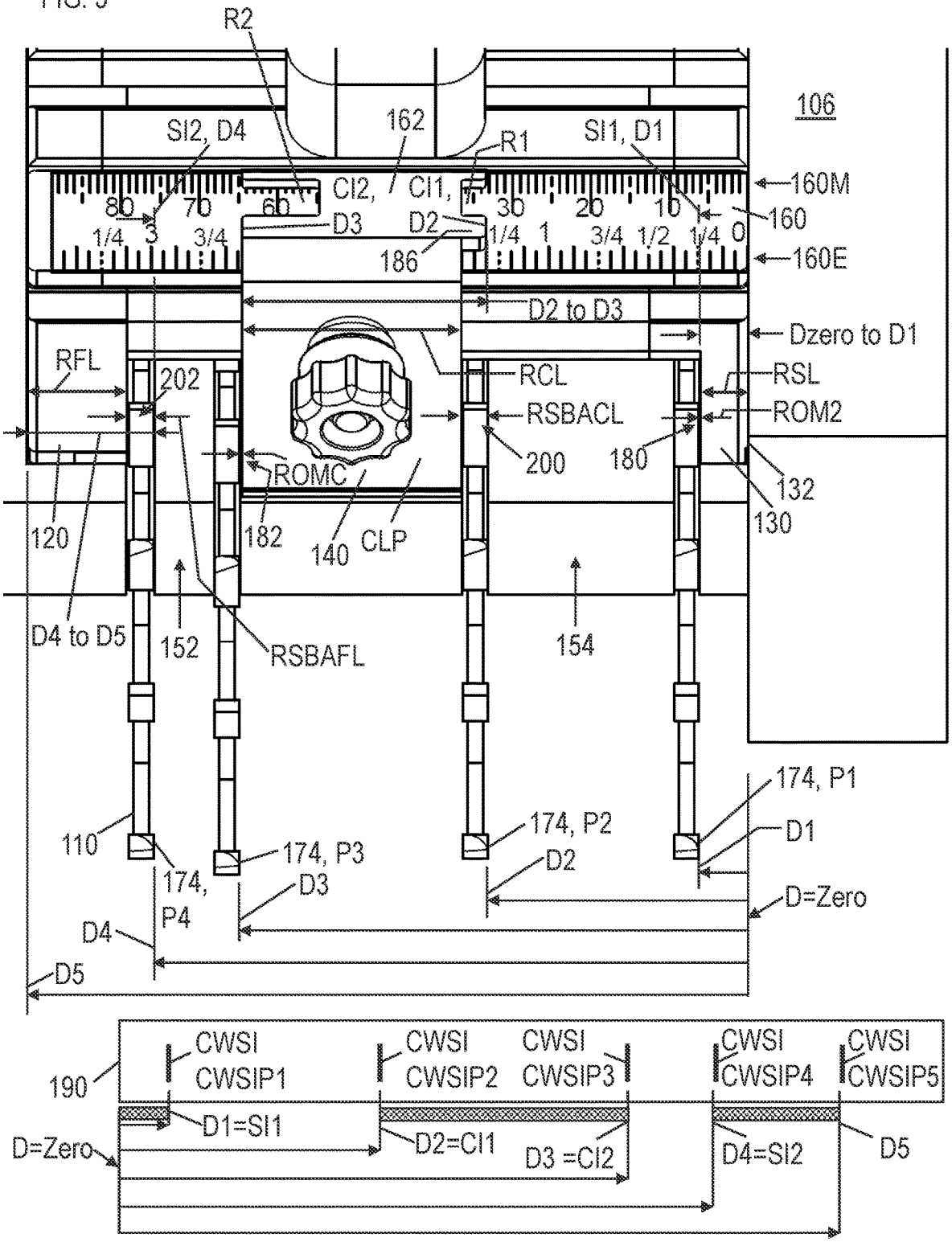
FIG. 3 and FIG. 4 are closeup top views of the push block of FIG. 2.

As can be seen in FIG. 3, a nearest point 174 of the saw blade 110 can be safely positioned anywhere from a first position P1 to a second position P2 (in the second tunnel 154), and anywhere from a third position P3 to a fourth position P4 (in the first tunnel 152).

The first position P1 is a safe minimum cut-width position for a saw blade 110 disposed in the second tunnel 154. The first position P1 is disposed at a first distance D1 that is measured from the fence side 132 of the second leg 130. When the fence side 132 of the second leg 130 abuts the fence 106 as shown, the first position P1 is also disposed at the first distance D1 measured from the fence 106. The scale 160 optionally includes a unique first scale indicator SI1 at a location on the scale that corresponds with the first distance D1. As used herein, unique means that the identifier is in addition to and distinguishable from the ruler/distance markings 160E, 160M on the scale 160. In this example embodiment shown, first distance D1 is ¼ inches, so the first scale indicator SI1 is disposed at ¼ inch on the scale 160.

The first distance D1 is disposed at an end of a range of distances Zero to D1 that are measured from the fence side 132 of the second leg 130 and that are associated with a location of the center leg 140. The range of distances Zero to D1 associated with the second leg 130 includes at least: 1) a range of distances RSL that are measured from the fence side 132 of the second leg 130 and that are occupied by the second leg 130; and 2) an optional range of distances ROM2 that are measured from the fence side 132 of the second leg 130 and that are occupied by an outside side safety margin 180 that abuts the outside side 134 of the second leg 130. The range of distances RSL that are measured from the fence side 132 of the second leg 130 and that are occupied by the second leg 130 tells where a width of the second leg 130 is located relative to the fence side 132 of the second leg 130 (and thereby relative to the fence 106). Similarly, the range of distances ROM2 that are measured from the fence side 132 of the second leg 130 and that are occupied by the outside side safety margin 180 tells where a width of the outside side safety margin 180 is located relative to the fence side 132 of the second leg 130 (and thereby relative to the fence 106).

For example, for a second leg 130 having an example width of ¼ inch, the range of distances RSL measured from the fence side 132 of the second leg 130 would be Zero to ¼ inches. This is because the second leg 130 starts at the fence side 132 of the second leg 130 (D=Zero) and extends its ¼-inch width therefrom. In contrast, for an outside side safety margin 180 having an example width of 1/16 inches (not shown), the range of distances ROM2 measured from the fence side 132 of the second leg 130 would be ¼ inch to 5/16 inch. This is because the outside side safety margin 180 starts at ¼ inches (where the outside side 134 of the second leg 130 is located) and extends its 1/16-inch width away from the outside side 134 of the second leg 130. In such an example embodiment (not shown), the first distance D1 would be 5/16 inches because the first distance D1 indicates an outside end of the range of distances Zero to D1 associated with the second leg 130, and because the range of distances Zero to D1 associated with the second leg 130 includes at least: 1) the range of distances RSL of Zero to ¼ inch plus 2) the range of distances ROM2 of ¼ inch to 5/16 inch. A width of the outside side safety margin 180 can be any suitable size.

The table saw includes a table saw ruler 190 that has a cut width setting indicator CWSI that indicates on the table saw ruler 190 a distance between the fence 106 and the nearest point 174 of the saw blade 110. In the example embodiment shown, when the saw blade 110 is the first position P1, the distance between the fence 106 and the nearest point 174 of the saw blade 110 is the first distance D1. Since the first scale indicator SI1 is disposed at the first distance D1 on the scale 160, an operator who sees the first scale indicator SI1 located at the first distance D1 on the scale 160 will know that the cut width setting indicator CWSI cannot be set below the first distance D1 on the table saw ruler 190 when the saw blade 110 is disposed in the second tunnel 154. This safe minimum cut-width position is indicated as a cut width setting indicator first position CWSIP1 on the table saw ruler 190.

The second position P2 is a safe maximum cut-width position for a saw blade 110 disposed in the second tunnel 154 when the center leg 140 is disposed at the center leg position CLP shown. The second position P2 is disposed at a second distance D2 that is measured from the fence side 132 of the second leg 130. When the fence side 132 of the second leg 130 abuts the fence 106 as shown, the second position P2 is also disposed at the second distance D2 from the fence 106.

The third position P3 is a safe minimum cut-width position for a saw blade 110 disposed in the first tunnel 152 when the center leg 140 is disposed at the center leg position CLP shown. The third position P3 is disposed at a third distance D3 that is measured from the fence side 132 of the second leg 130. When the fence side 132 of the second leg 130 abuts the fence 106 as shown, the third position P3 is also disposed at the third distance D3 from the fence 106.

The cursor 162 includes a first cursor indicator Cl1 that is configured to be positioned at a location on the scale that corresponds with the second distance D2. In an example embodiment, the first cursor indicator Cl1 is a fence-side bitter end of a tab 186 that is part of the scale 160, and the scale 160 overlies the scale 160. In an example embodiment, scale 160 is composed of an opaque material that blocks visual access to a portion of the scale 160 thereunder. Alternately, the first cursor indicator Cl1 may be a pointer or the like. In this example embodiment shown, second distance D2 is 1 5/16 inch, so the first cursor indicator Cl1 is disposed at 1 5/16 inches on the scale 160.

The cursor 162 includes a second cursor indicator Cl21 that is configured to be positioned at a location on the scale that corresponds with the third distance D3. In an example embodiment, the second cursor indicator Cl2 is an outside-side bitter end of the scale 160. In this example embodiment shown, third distance D3 is slightly under 2-9/16 inches, so the second cursor indicator Cl2 is disposed at slightly under 2 9/16 inches on the scale 160. The cursor 162 may include a second tab (not shown) that extends away from the fence 106 and which includes the second cursor indicator Cl2. The cursor 162 may further include one or more recesses R1, R2 between the first cursor indicator Cl1 and the second cursor indicator Cl2 that is configured to expose at least a portion of the scale 160 between the first cursor indicator Cl1 and the second cursor indicator Cl2 for operator convenience.

The second distance D2 is disposed at an end of a range of distances D2 to D3 that are measured from the fence side 132 of the second leg 130 and that are associated with a location of the center leg 140. The range of distances D2 to D3 associated with the center leg 140 includes at least: 1) a range of distances RCL that are measured from the fence side 132 of the second leg 130 and that are occupied by the center leg 140; 2) a range of distances RSBACL that are measured from the fence side 132 of the second leg 130 and that are occupied by a saw blade allowance 200 that abuts a fence side 142 of the center leg 140; and 3) an optional range of distances ROMC that are measured from the fence side 132 of the second leg 130 and that are occupied by an outside side safety margin 182 that abuts the outside side 144 of the second leg 130.

The saw blade allowance 200 accounts for a thickness of the saw blade 110. This is necessary because the table saw ruler 190 references the nearest point 174 of the saw blade 110, which is disposed on a fence side of the saw blade 110, whereas the center leg 140 is disposed on the other/outside side of the saw blade 110. The tab 186 of the cursor 162 enables the cursor 162 to indicate the second distance D2 on the scale 160 by extending over the scale 160 toward the fence 106 to reach the location on the scale 160 of the nearest point 174 of the saw blade 110. The saw blade allowance 200 can be any suitable size. Common table saw blade thickness range from 1/16 inch to 1/8 inch thick. Consequently, the saw blade allowance 200 may commonly be at least 1/16 inch. In an example embodiment, the saw blade allowance 200 is 1/8 inch plus a suitable (fence side) safety margin. Example suitable safety margins are 1/32 inch or larger.

The range of distances RCL that are measured from the fence side 132 of the second leg 130 and that are occupied by the center leg 140 tells where a width of the center leg 140 is located relative to the fence side 132 of the second leg 130 (and thereby relative to the fence 106). Similarly, the range of distances RSBACL that are measured from the fence side 132 of the second leg 130 and that are occupied by the saw blade allowance 200 tells where a width of the saw blade allowance 200 is located relative to the fence side 132 of the second leg 130 (and thereby relative to the fence 106). Likewise, the range of distances ROMC that are measured from the fence side 132 of the second leg 130 and that are occupied by the outside side safety margin 182 tells where a width of the outside side safety margin 182 is located relative to the fence side 132 of the second leg 130 (and thereby relative to the fence 106).

For example, for a center leg 140 having an example width of 1 1/16 inch, the range of distances RCL measured from the fence side 132 of the second leg 130 would be approximately 1 7/16 inch to 2 1/2 inch. This is because the center leg 140 starts at 1 7/16 inches and extends its 1 1/16 inch width therefrom. For a saw blade allowance 200 having an example width of 1/8 inch, the range of distances RSBACL measured from the fence side 132 of the second leg 130 would be approximately 1 7/16 inch to 1-5/16 inch. This is because the saw blade allowance 200 starts at 1 7/16 inches (where the fence side 142 of the center leg 140 is located) and extends it's 1/8-inch width toward the second leg 130 (and thereby toward the fence 106). For an outside side safety margin 182 having an example width of 1/16 inch (not shown), the range of distances ROMC measured from the fence side 132 of the second leg 130 would be approximately 2 1/2 inch to 2 5/16 inch. This is because the outside side safety margin 180C starts at 2 1/2 inches (where the outside side 144 of the center leg 140 is located) and extends its 1/16-inch width away from the outside side 144 of the center leg 140.

In such an example embodiment (not shown), the second distance D2 would be 1 5/16 inches because the second distance D2 indicates a fence side end of the range of distances D2 to D3 associated with the center leg 140, and because the range of distances D2 to D3 associated with the center leg 140 includes at least: 1) the range of distances RCL of 1 7/16 inch to 2 1/2 inch, plus 2) the range of distances RSBACL of I-7/16 inch to 1 5/16 inch, plus 3) the range of distances ROM2 of 2 1/2 inch to 2 5/16 inch. A width of the outside side safety margin 182 can be any suitable size. The third distance D3 would be 2 5/16 inches because the third distance D3 represents an outside end of the range of distances D2 to D3.

In the example embodiment shown, when the saw blade 110 is the second position P2, the distance between the fence 106 and the nearest point 174 of the saw blade 110 is the second distance D2. Since the first cursor indicator Cl1 is disposed at the second distance D2 on the scale 160, an operator who sees the first cursor indicator Cl1 located at the second distance D2 on the scale 160 will know that the cut width setting indicator CWSI cannot be set above the second distance D2 on the table saw ruler 190 when the saw blade 110 is disposed in the second tunnel 154. This safe maximum cut-width position is indicated as a cut width setting indicator second position CWSIP2 on the table saw ruler 190.

Similarly, when the saw blade 110 is the third position P3, the distance between the fence 106 and the nearest point 174 of the saw blade 110 is the third distance D3. Since the second cursor indicator Cl2 is disposed at the third distance D3 on the scale 160, an operator who sees the second cursor indicator Cl2 located at the third distance D3 on the scale 160 will know that the cut width setting indicator CWSI cannot be set below the third distance D3 on the table saw ruler 190 when the saw blade 110 is disposed in the first tunnel 152. This safe minimum cut-width position is indicated as a cut width setting indicator third position CWSIP3 on the table saw ruler 190.

In an example embodiment, the center leg 140 is laterally adjustable. Movement of the center leg 140 will cause the second position P2 and the third position P3 to change. This, in turn, will cause the second distance D2 and the third distance D3 to change. However, the cursor 162 and associated first cursor indicator Cl1 and second cursor indicator Cl2 move with the center leg 140. As a result, the first cursor indicator Cl1 and the second cursor indicator Cl2 will always indicate the second distance D2 and the third distance D3 respectively on the scale 160. The second distance D2 corresponds to the correct safe maximum cut-width position for a saw blade 110 disposed in the second tunnel 154, and the third distance D3 corresponds to the correct safe minimum cut-width position for a saw blade 110 disposed in the first tunnel 152. Consequently, the first cursor indicator Cl1 and the second cursor indicator Cl2 will always indicate the correct safe maximum cut-width position for a saw blade 110 disposed in the second tunnel 154 and the correct safe minimum cut-width position for a saw blade 110 disposed in the first tunnel 152 for any location of the center leg 140.

The fourth position P4 is a safe maximum cut-width position for a saw blade 110 disposed in the first tunnel 152. The fourth position P4 is disposed at a fourth distance D4 that is measured from the fence side 132 of the second leg 130. When the fence side 132 of the second leg 130 abuts the fence 106 as shown, the fourth position P4 is also disposed at the fourth distance D4 from the fence 106. The scale 160 optionally includes a unique second scale indicator SI2 at a location on the scale that corresponds with the fourth distance D4. As used herein, unique means that the identifier is in addition to and distinguishable from the ruler markings on the scale.

The fourth distance D4 is disposed at a fence end of a range of distances D4 to D5 that are measured from the fence side 132 of the second leg 130 and that are associated with a location of the first leg 120. The range of distances D4 to D5 associated with the first leg 120 includes at least: 1) a range of distances RFL that are measured from the fence side 132 of the second leg 130 and that are occupied by the first leg 120; and 2) a range of distances RSBAFL that are measured from the fence side 132 of the second leg 130 and that are occupied by a saw blade allowance 202 that abuts a fence side 122 of the first leg 120. Similar to the saw blade allowance 200, the saw blade allowance 202 accounts for a thickness of the saw blade 110. The saw blade allowance 200 and 202 may or may not be the same as each other.

The range of distances RFL that are measured from the fence side 132 of the second leg 130 and that are occupied by the first leg 120 tells where a width of the first leg 120 is located relative to the fence side 132 of the second leg 130 (and thereby relative to the fence 106). Similarly, the range of distances RSBAFL that are measured from the fence side 132 of the second leg 130 and that are occupied by the saw blade allowance 202 tells where a width of the saw blade allowance 202 is located relative to the fence side 132 of the second leg 130 (and thereby relative to the fence 106).

For example, for a first leg 120 having an example width of ½ inch, the range of distances RFL measured from the fence side 132 of the second leg 130 would be 3⅛ inch to approximately 3⅝ inch. This is because the first leg 120 starts at 3⅛ inches and extends its ½-inch width therefrom. For a saw blade allowance 202 having an example width of ⅛ inch, the range of distances RSBAFL measured from the fence side 132 of the second leg 130 would be approximately 3 inches to 3⅛ inches. This is because the saw blade allowance 202 starts at approximately 3⅛ inches (where the fence side 122 of the first leg 120 is located) and extends it's ⅛-inch width toward the second leg 130 (and thereby toward the fence 106).

In such an example embodiment, the fourth distance D4 would be 3 inches because the fourth distance D4 indicates a fence end of the range of distances D4 to D5 associated with the first leg 120, and because the range of distances D4 to D5 associated with the first leg 120 includes at least: 1) the range of distances RFL of 3⅛ inches to approximately 3⅝ inches plus 2) the range of distances RSBAFL of 3⅛ inches to three (3) inches.

In the example embodiment shown, when the saw blade 110 is the fourth position P4, the distance between the fence 106 and the nearest point 174 of the saw blade 110 is the fourth distance D4. Since the second scale indicator SI2 is disposed at the fourth distance D4 on the scale 160, an operator who sees the second scale indicator SI2 located at the fourth distance D4 on the scale 160 will know that the cut width setting indicator CWSI cannot be set above the fourth distance D4 on the table saw ruler 190 when the saw blade 110 is disposed in the first tunnel 152. This safe maximum cut-width position is indicated as a cut width setting indicator second position CWSIP4 on the table saw ruler 190.

In an example embodiment, the scale 160 could be extended to the outside side 124 of the first leg 120 and could include a third scale indicator SI3 (not shown) that would indicate the fifth distance D5 and a corresponding safe minimum cut-width position for a saw blade 110 disposed laterally outside/astride the push block 102. An operator who sees the third scale indicator located at the fifth distance D5 on the scale 160 would know that the cut width setting indicator CWSI cannot be set below the fifth distance D5 on the table saw ruler 190 when the saw blade 110 is disposed laterally outside the push block 102. This safe minimum cut-width position is optionally indicated as a cut width setting indicator fifth position CWSIPS on the table saw ruler 190. As with the first distance D1 and the second distance D3, an optional outside safety margin (not shown) could be included added to the range D4 tO D5 and thereby be accounted for by the fifth distance D5.

Figure 4:
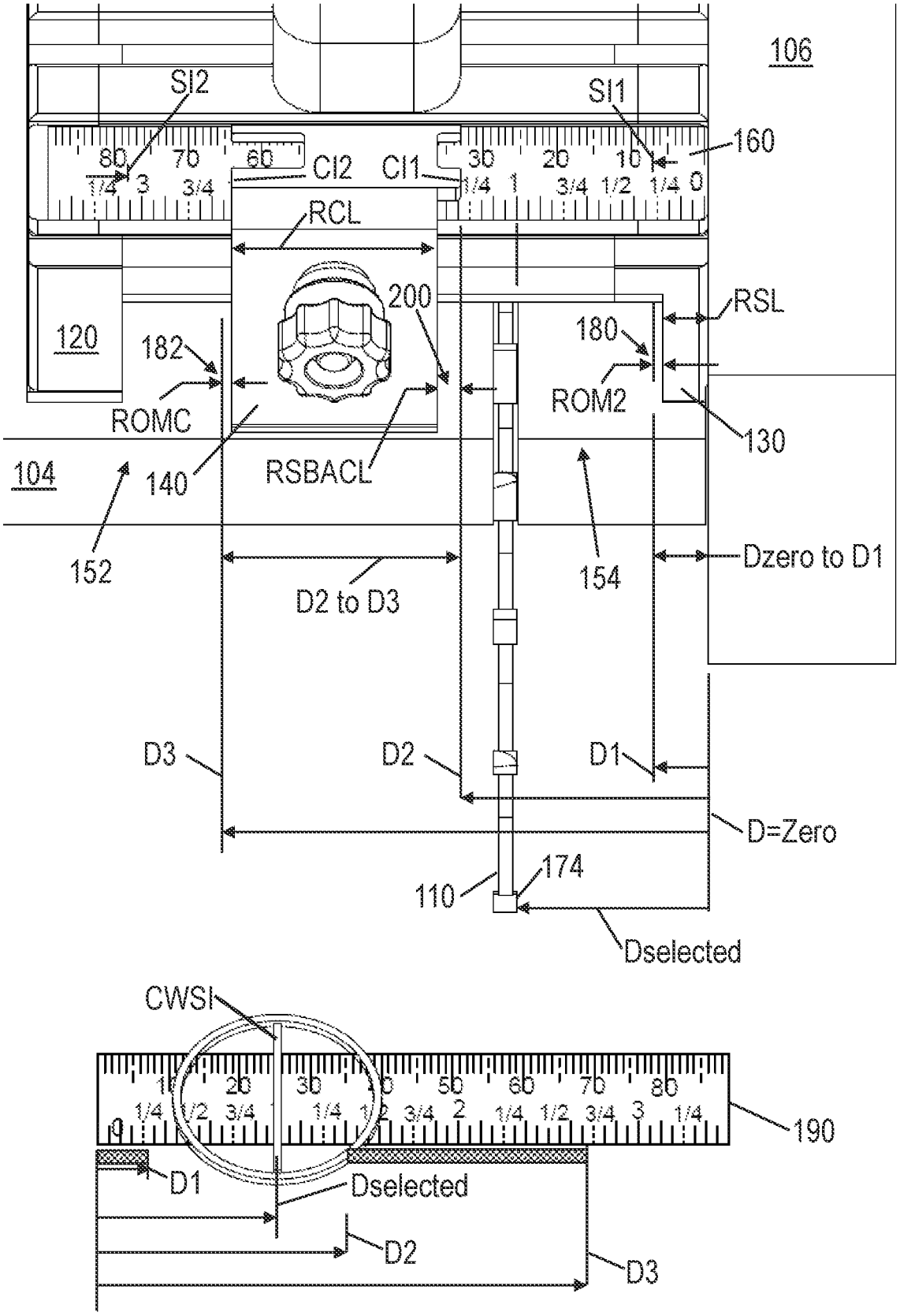

FIG. 4 is a close-up view of the push block 102 of FIG. 2 pushing a workpiece 104 across the saw blade 110, which is disposed in the second tunnel 154. Just like in FIG. 2, the first distance D1 is disposed at an outside end of the range of distances Zero to D1 that are measured from the fence side 132 of the second leg 130 and that are associated with a location of the second leg 130. The range of distances Zero to D1 includes: 1) the range of distances RSL that are measured from the fence side 132 of the second leg 130 and that are occupied by the second leg 130; and 2) the optional range of distances ROM2 that are measured from the fence side 132 of the second leg 130 and that are occupied by an outside side safety margin 180 that abuts the outside side 134 of the second leg 130.

Also just like in FIG. 2, the second distance D2 is a fence end and the third distance D3 is an outside end of a range of distances D2 to D3 that are measured from the fence side 132 of the second leg 130 and that are associated with a location of the center leg 140. The range of distances D2 to D3 associated with the center leg 140 includes: 1) the range of distances RCL that are measured from the fence side 132 of the second leg 130 and that are occupied by the center leg 140; 2) the range of distances RSBACL that are measured from the fence side 132 of the second leg 130 and that are occupied by a saw blade allowance 200 that abuts a fence side 132 of the center leg 140; and 3) the range of distances ROMC that are measured from the fence side 132 of the second leg 130 and that are occupied by an outside side safety margin 182 that abuts the outside side 134 of the second leg 130.

The saw blade 110 is located at a selected distance Dselected from the fence 106. An operator can see the cut width setting indicator CWSI is correspondingly located at approximately one (1) inch on the table saw ruler 190. The operator can also see on the scale 160 that one (1) inch is safely above the first scale indicator S11. Since the first scale indicator SI1 indicates the safe minimum cut-width position for a saw blade 110 disposed in the second tunnel 154, this means that the saw blade 110 will not contact the second leg 130 during a cutting operation. The operator can also see on the scale 160 that one (1) inch is safely below the first cursor indicator Cl1. Since the first cursor indicator Cl1 indicates the safe maximum cut-width position for a saw blade 110 disposed in the second tunnel 154, this means that the saw blade 110 will not contact the center leg 140 during a cutting operation.

Figure 5:
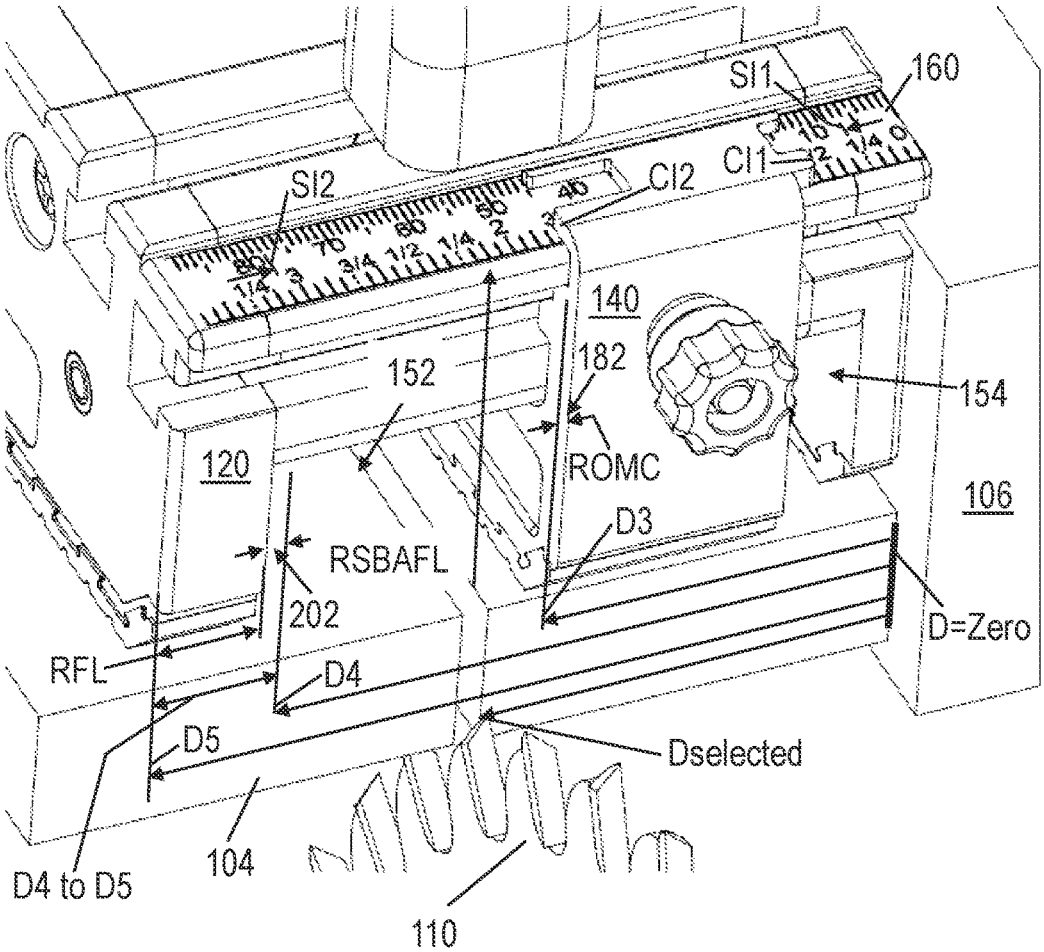
FIG. 5 and FIG. 6 are perspective views of the push block of FIG. 2.
Figure 5:
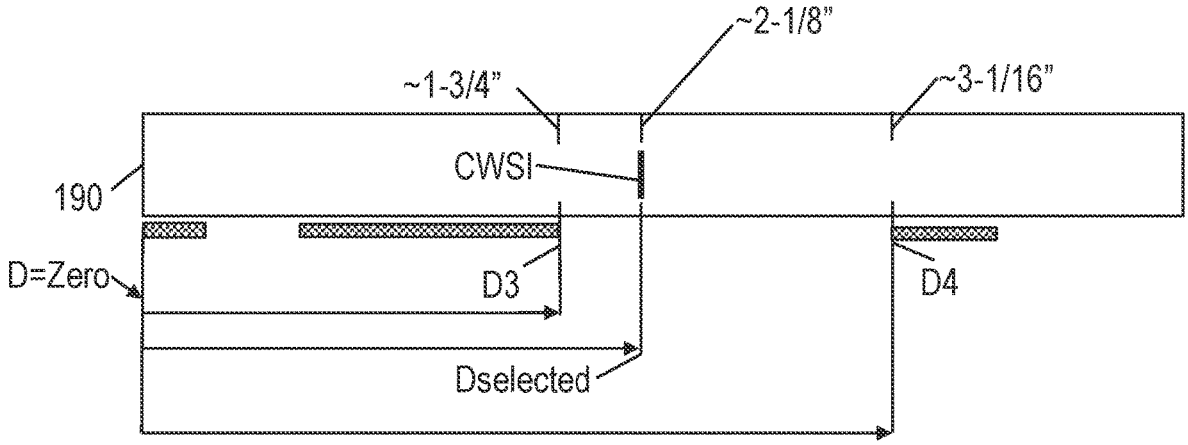

FIG. 5 is a perspective view of the push block 102 of FIG. 2 pushing a workpiece 104 across the saw blade 110, which is disposed in the first tunnel 152. Just like in FIG. 2, the third distance D3 is an outside end of a range of distances D2 to D3 that are measured from the fence side 132 of the second leg 130 and that are associated with a location of the center leg 140.

Also like that in FIG. 2, the fourth distance D4 is disposed at a fence end of a range of distances D4 to D5 that are measured from the fence side 132 of the second leg 130 and that are associated with a location of the first leg 120. The range of distances D4 to D5 associated with the first leg 120 includes at least: 1) a range of distances RFL that are measured from the fence side 132 of the second leg 130 and that are occupied by the first leg 120; and 2) a range of distances RSBAFL that are measured from the fence side 132 of the second leg 130 and that are occupied by a saw blade allowance 202 that abuts a fence side 122 of the first leg 120. Similar to the saw blade allowance 200, the saw blade allowance 202 accounts for a thickness of the saw blade 110.

The saw blade 110 is located at a selected distance Dselected from the fence 106. An operator can see the cut width setting indicator CWSI is correspondingly located at approximately 2⅛ inch on the table saw ruler 190. The operator can also see that 2⅛ inch on the scale 160 is safely above the second cursor indicator Cl2. Since the second cursor indicator Cl2 indicates the safe minimum cut-width position for a saw blade 110 disposed in the first tunnel 152, this means that the saw blade 110 will not contact the center leg 140 during a cutting operation. The operator can also see that the 2⅛ inch on the scale 160 is safely below the second scale indicator SI2. Since the second scale indicator SI2 indicates the safe maximum cut-width position for a saw blade 110 disposed in the first tunnel 152, this means that the saw blade 110 will not contact the first leg 120 during a cutting operation.

Figure 6:
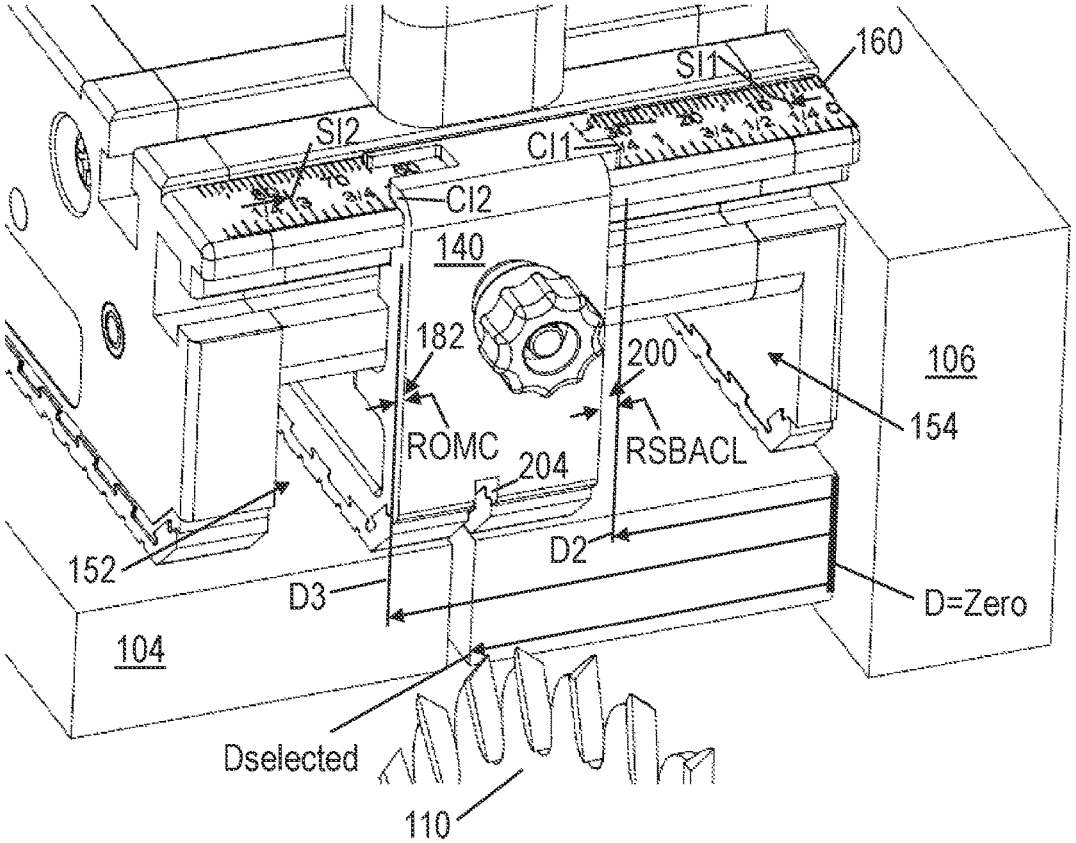
Figure 6:
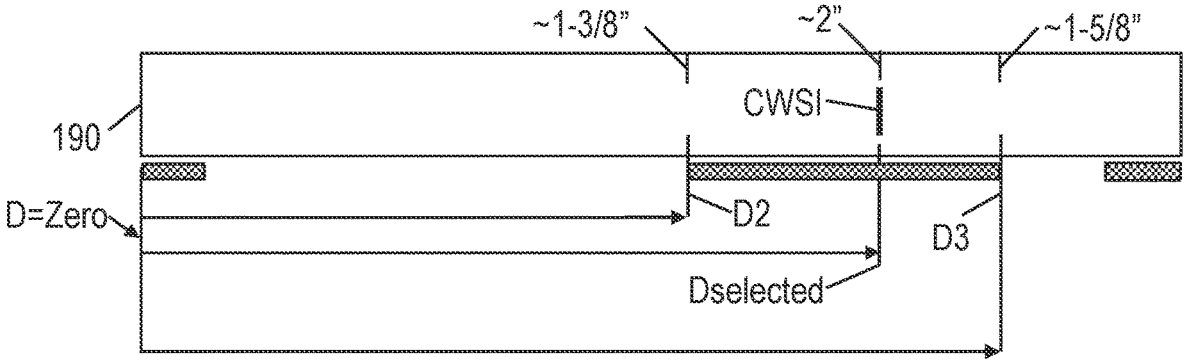

FIG. 6 is a perspective view of the push block 102 of FIG. 2 pushing a workpiece 104 across the saw blade 110, in which the saw blade 110 has contacted the center leg 140. Just like in FIG. 2, the second distance D2 is a fence end and the third distance D3 is an outside end of a range of distances D2 to D3 that are measured from the fence side 132 of the second leg 130 and that are associated with a location of the center leg 140.

The saw blade 110 is located at a selected distance Dselected from the fence 106. An operator can see the cut width setting indicator CWSI is located at approximately 2 inches on the table saw ruler 190. The operator can see that 2 inches on the scale 160 is not safely below the first cursor indicator Cl1. Since the first cursor indicator Cl1 indicates the safe maximum cut-width position for a saw blade 110 disposed in the second tunnel 154, this means that the saw blade 110 will not be safely disposed in the second tunnel 154 during a cutting operation. The operator can also see that 2 inches on the scale 160 is not safely above the second cursor indicator Cl2. Since the second cursor indicator Cl2 indicates the safe minimum cut-width position for a saw blade 110 disposed in the first tunnel 152, this means that the saw blade 110 will also not be safely disposed in the first tunnel 152 during a cutting operation. Since the cut width setting indicator CWSI indicates a position that is both above the safe maximum cut-width position for a saw blade 110 disposed in the second tunnel 154 and below the safe minimum cut-width position for a saw blade 110 disposed in the first tunnel 152, the operator will understand that the saw blade 110 will contact the center leg 140 in this configuration.

In the example embodiment shown, the operator can simply see that the cut width setting indicator CWSI is correspondingly located between the first cursor indicator Cl1 and the second cursor indicator Cl2, which means the saw blade 110 will contact the center leg 140. In the example embodiment shown, the cursor 162 is composed of an opaque material that blocks visual access to the scale indicators on the scale 160 and under the cursor 162. Consequently, the operator would not be able to see the 2-inch indicator on the scale 160, which would mean that the saw blade 110 would contact the center leg 140. Example damage resulting from pushing the push block 102 over the saw blade 110 in this configuration is visible in the center leg 140.

The apparatus disclosed herein provides a visual reference that allows an operator to quickly assess proper settings and avoid equipment damage before a cutting operation without having to make any calculations or use any measuring devices. Consequently, the disclosed apparatus represents an improvement in the art.

While various embodiments of the present invention have been shown and described herein, it will be obvious that such embodiments are provided by way of example only. Numerous variations, swapping of features among embodiments, changes, and substitutions may be made without departing from the invention herein. Accordingly, it is intended that the invention be limited only by the spirit and scope of the appended claims.

The invention claimed is:

1. An apparatus, comprising:

a push block configured to push a workpiece across a table saw, the push block comprising:

a first leg, a second leg comprising a fence side configured to abut a fence of the table saw, and a center leg disposed between the first leg and the second leg, wherein the first leg and the center leg define a first tunnel therebetween, the center leg and the second leg define a second tunnel therebetween wherein the center leg is adjustably positionable between the first leg and the second leg, and wherein adjustment of a position of the center leg adjusts a first tunnel width and a second tunnel width;

a scale that comprises distance indicators that are configured to indicate a distance along the push block from the fence when the fence side of the second leg abuts the fence; and a cursor configured to move along the scale with the center leg includes a first indicator on a first side of a center leg that is configured to set a safe maximum cut width in the second tunnel and includes a second indicator on an opposing second side of the center leg that is configured to set a safe minimum cut width in the first tunnel.

2. The apparatus of claim 1, wherein the safe maximum cut-width setting comprises a distance measured from the fence side of the second leg to a fence side of the center leg minus a blade-thickness allowance of at least 1/16 inch.

3. The apparatus of claim 1, wherein the safe minimum cut-width setting comprises a distance measured from the fence side of the second leg to an outside side of the center leg.

4. The apparatus of claim 1, wherein the safe minimum cut-width setting comprises a distance measured from the fence side of the second leg to an outside side of the center leg plus an outside side safety margin distance that extends from the outside side of the center leg.

5. The apparatus of claim 1, wherein the scale comprises a first scale indicator that uniquely indicates a safe minimum cut-width setting for a saw blade disposed in the second tunnel.

6. The apparatus of claim 1, wherein the scale uniquely comprises a second scale indicator that uniquely indicates a safe maximum cut-width setting for a saw blade in the first tunnel.

7. The apparatus of claim 1, wherein the cursor overlies the scale to at least partly cover each of the cut-width settings between the safe maximum cut-width setting and the safe minimum cut-width setting.

8. The apparatus of claim 7, wherein the cursor comprises an opaque material that overlies the scale to at least partly cover each of the cut-width settings between the safe maximum cut-width setting and the safe minimum cut-width setting.

9. An apparatus, comprising:

a push block configured to push a workpiece across a table saw, the push block comprising:

a first leg, a second leg comprising a fence side configured to abut a fence of the table saw, and a center leg disposed between the first leg and the second leg, wherein the first leg and the center leg define a first tunnel therebetween, and wherein the center leg and the second leg define a second tunnel therebetween, wherein the center leg is adjustably positionable between the first leg and the second leg, and wherein adjustment of a position of the center leg adjusts a first tunnel width and a second tunnel width;

a scale that comprises distance indicators that are configured to indicate a distance along the push block from the fence side of the second leg; and a cursor configured to move along the scale with the center leg and to indicate on the scale boundaries of a range of unsafe distances that are measured from the fence side of the second leg, wherein the range of unsafe distances is bounded by a first indicator on a first side of the center leg that is configured to set a safe maximum cut-width for a saw blade in the second tunnel and a second indicator on an opposing side of the center leg that is configured to set a safe minimum cut-width for a saw blade disposed in the first tunnel.

10. The apparatus of claim 9, wherein the range of unsafe distances comprises:

an outside side safety margin range of distances bounded on a first end by a measurement from the fence side of the second leg to an outside side of the center leg; and bounded on a second end by a measurement from the fence side of the second leg to the outside side of the center leg plus a safety margin distance that extends from the outside side of the center leg.

11. The apparatus of claim 10, wherein the range of unsafe distances further comprises:

a blade-thickness allowance range of distances bounded on a first end by the measurement from the fence side of the second leg to the fence side of the center leg; and bounded on a second end by the measurement from the fence side of the second leg to the fence side of the center leg minus a blade-thickness allowance distance.

12. The apparatus of claim 11, wherein a magnitude of the blade-thickness allowance distance is at least 1/16 inch.

13. The apparatus of claim 9, wherein the cursor comprises an opaque material that overlies the scale to at least partly cover the cut-width settings between the sale maximum cut-width setting and the safe minimum cut-width setting.

14. The apparatus of claim 13, wherein the opaque material comprises at least one recess between the first cursor indicator and the second cursor indicator that is configured to expose at least a portion of the scale between the first cursor indicator and the second cursor indicator.

15. The apparatus of claim 9, wherein the scale comprises a unique first scale indicator that indicates on the scale an end of a second range of unsafe distances that are measured from the fence side of the second leg and that are associated with a location of the second.

16. The apparatus of claim 15, wherein the second range of unsafe distances associated with the location of the second leg comprises:

a second leg range of contact distances that are bounded on a first end by a measurement of zero, bounded on a second end by a measurement from the fence side of the second leg to an outside side of the second leg, and in which a saw blade that is set to any of the second leg range of contact distances will contact the second leg when the fence side of the second leg abuts the fence; and an outside side safety margin range of distances bounded on a first end by the measurement from the fence side of the second leg to the outside side of the second leg; and bounded on a second end by the measurement from the fence side of the second leg to the outside side of the second leg plus a safety margin distance that extends from the outside side of the second leg.

17. The apparatus of claim 9, wherein the scale comprises a unique second scale indicator that indicates an end of a third range of unsafe distances that are measured from the fence side of the second leg and that are associated with a location of the first.

18. The apparatus of claim 17, wherein the third range of unsafe distances associated with the location of the first leg comprises:

a first leg range of contact distances that are bounded on a first end by a measurement from the fence side of the second leg to a fence side of the first leg, bounded on a second end by a measurement from the fence side of the second leg to an outside side of the first leg, and in which a saw blade that is set to any of the first leg range of contact distances will contact the first leg when the fence side of the second leg abuts the fence; and a blade-thickness allowance range of distances bounded on a first end by the measurement from the fence side of the second leg to the fence side of the first leg; and bounded on a second end by the measurement from the fence side of the second leg to the fence side of the first leg minus a blade-thickness allowance distance.

* * * * *